US010570895B2

(12) United States Patent
Speijers

(10) Patent No.: US 10,570,895 B2
(45) Date of Patent: Feb. 25, 2020

(54) PUMP SYSTEM

(71) Applicant: RIO BOXX HOLDING B.V., Utrecht (NL)

(72) Inventor: Sam Speijers, Utrecht (NL)

(73) Assignee: RIO BOXX HOLDING B.V., Utrecht (NL)

( * ) Notice: Subject to any disclaimer, the term of this patent is extended or adjusted under 35 U.S.C. 154(b) by 297 days.

(21) Appl. No.: 15/550,411

(22) PCT Filed: Feb. 8, 2016

(86) PCT No.: PCT/NL2016/050091
§ 371 (c)(1),
(2) Date: Aug. 11, 2017

(87) PCT Pub. No.: WO2016/129999
PCT Pub. Date: Aug. 18, 2016

(65) Prior Publication Data

US 2018/0030981 A1 Feb. 1, 2018

(30) Foreign Application Priority Data

Feb. 12, 2015 (NL) ..... 2014285

(51) Int. Cl.
*F04B 49/22* (2006.01)
*E03F 5/22* (2006.01)
(Continued)

(52) U.S. Cl.
CPC ..... *F04B 49/225* (2013.01); *E03F 5/22* (2013.01); *F04B 49/22* (2013.01); *E03B 5/02* (2013.01); *E03F 5/125* (2013.01)

(58) Field of Classification Search
CPC ..... F04B 13/02; F04B 49/225; E03F 5/125; E03F 5/22
See application file for complete search history.

(56) References Cited

U.S. PATENT DOCUMENTS 5,152,670 A * 10/1992 Waldecker ..... F04D 15/0218 200/83 T
5,701,873 A 12/1997 Schneider
(Continued)

FOREIGN PATENT DOCUMENTS

DE 2651885 A1 5/1978
FR 2964423 A1 3/2012

OTHER PUBLICATIONS

International Search Report dated Jun. 17, 2016, in PCT/NL2016/050091, filed Feb. 8, 2016.

*Primary Examiner* — Patrick Hamo
(74) *Attorney, Agent, or Firm* — Oblon, McClelland, Maier & Neustadt, L.L.P.

(57) ABSTRACT

A pump system for liquid media includes at least one pump having a suction side and a delivery side, a control unit connected to the at least one pump, and at least two controllable valves connected on one side thereof to the suction side. The valves are controlled by the control unit connected thereto, such that each valve only allows passage of medium from a first source or second source connectable to their respective other valve sides. The pump system also includes at least one level sensor connected to the control unit, which level sensor is positioned at least near the source where, in the case of a critical level being exceeded, medium must be pumped away.

16 Claims, 3 Drawing Sheets

Figure 1:
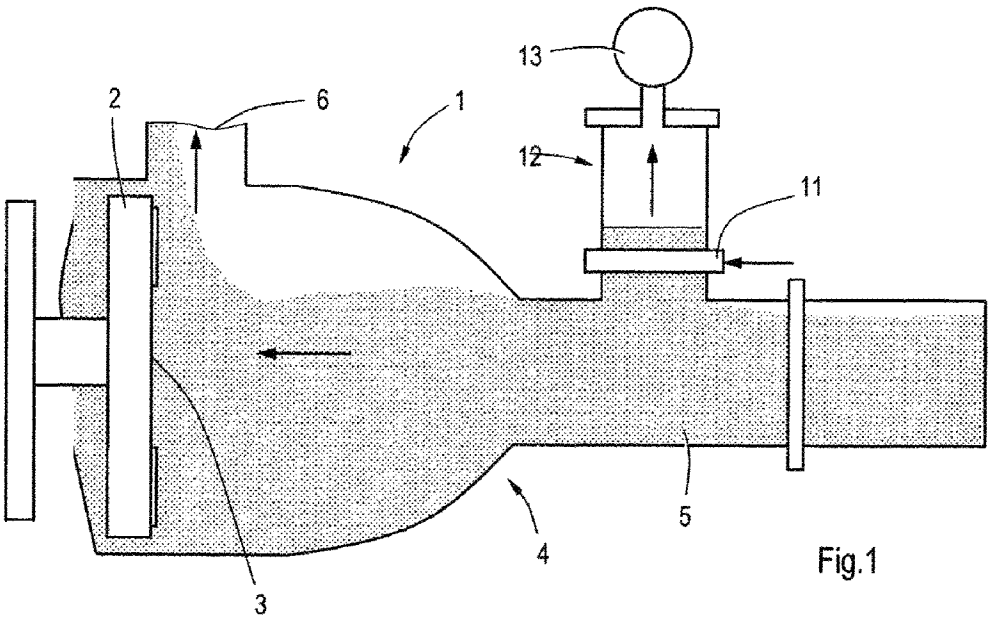

(51) Int. Cl.
*E03B 5/02* (2006.01)
*E03F 5/12* (2006.01)

(56) References Cited

U.S. PATENT DOCUMENTS

| | | | | | |
|---|---|---|---|---|---|
| 6,138,750 | A * | 10/2000 | Ford | B01D 21/245 | 166/312 |
| 7,309,216 | B1 * | 12/2007 | Spadola, Jr. | F04B 49/02 | 417/18 |
| 7,887,305 | B2 * | 2/2011 | Yajima | F04B 43/0081 | 138/30 |
| 8,047,815 | B2 * | 11/2011 | Savard | F04B 13/02 | 222/135 |
| 8,828,192 | B2 * | 9/2014 | Demers | B01D 1/0035 | 203/1 |
| 9,771,712 | B1 * | 9/2017 | Wilson | E03F 5/22 | |
| 2010/0158716 | A1 * | 6/2010 | Laessle | F04B 13/02 | 417/395 |
| 2013/0129529 | A1 | 5/2013 | Laessle et al. | | |
| 2013/0309105 | A1 | 11/2013 | Laessle et al. | | |
| 2015/0322938 | A1 | 11/2015 | Laessle et al. | | |
| 2017/0089331 | A1 * | 3/2017 | Bialick | B66B 11/0005 | |

* cited by examiner

PUMP SYSTEM

The present invention relates to a pump system for liquid media.

The present invention also relates to a method which can suitably be used, inter alia, in such a pump system, and to the use of a level sensor, in particular a capacitive level sensor.

Such a system comprising valves is generally known. Hitherto, clean water from, for example, well-point dewatering was drained off using a certain pump system, while, additionally, in the case of waste water use was made of a different pump system. Due to different requirements to be imposed thereon, inter alia, to meet the required capacity and/or availability, or in connection with the degree of pollution of the water to be pumped, both systems including the respective associated fittings, such as usually diesel-electric pump drives, housings, tubes, hoses and couplings, were installed and maintained in operation independently of each other.

It is an object of the present invention to provide a single universal pump system by means of which different types of water, in particular water with different degrees of pollution and contaminations can be pumped.

To achieve this object, the system according to the invention has the characteristics of claim 1.

An advantage of the pump system according to the invention resides in that by virtue of a correct timing, tuned to the supply of both waste water and clean water, of the operation of the control unit of, in particular, the two or more (first) valves connected to the suction side, this supply can be supplied, if necessary, by the same pump or the same combination of pumps for further processing. As a result, individual fittings for pumping different kinds of water are superfluous. In respect of the above-mentioned timing, in practice, the urgency of said supply plays an important role. For example, in the case of a large amount of sewage water to be drained off because the sewage pipes are filled to capacity and will otherwise cause problems or overflow, the valve admitting sewage water is opened and the other one dealing with, for example, clean water from well-point dewatering is closed. And if the sewage pipes are sufficiently empty, the relevant valve is closed and, subsequently, the valve for the supply of clean water can be opened again.

When pumping waste water, whether or not in combination with clean water, it is desirable for the automatic operation of the pump system that it comprises a reliable waste water level detector. This detector preferably is, for example, a capacitive level detector which is to be mounted in a proper way.

A preferred embodiment of the system according to the invention is characterized in that the waste water source at least comprises a drain pipe and a substantially vertical pipe provided in a sealing manner on an opening in the drain pipe, in which or at which vertical pipe, sewage water can collect, and which vertical pipe has an inside surface and an outside surface, wherein one electrode of the level sensor, being a capacitive inductive level sensor and/or a resistance-measuring sensor, is arranged on the inside surface and the other electrode is arranged on the outside surface of said pipe to detect exceedance of the critical level.

An advantage of this embodiment of the system according to the invention is that, in spite of the sometimes high degree of pollution of the water, the indication of the level of waste water is reliable for a level sensor constructed as described hereinabove. This can be attributed to the fact that if waste water collects between the vertical distance of the electrodes on the inside and outside surface, the sensor usually electrically informs the control unit that an exceedance occurs, which control unit, in short, closes the clean water valve and opens the sewage water valve, after which the pump starts pumping sewage water. A level sensor, in particular a capacitive level sensor, which is arranged and used in said way, is substantially insensitive to the degree of pollution of the supply of waste water, because it continues to correctly detect the supply of waste water in the substantially vertical pipe.

A further preferred embodiment, which enables separate processing, i.e., input and output of one kind of water supplied, is characterized in that the pump system comprises at least two controllable valves connected on one valve side to the delivery side, which are controlled in such a manner by the control unit connected thereto that each valve only allows passage of medium from the first source and/or the second source.

Further detailed, possible embodiments explained in the other claims are mentioned, together with the associated advantages, in the following description.

Figure 2:
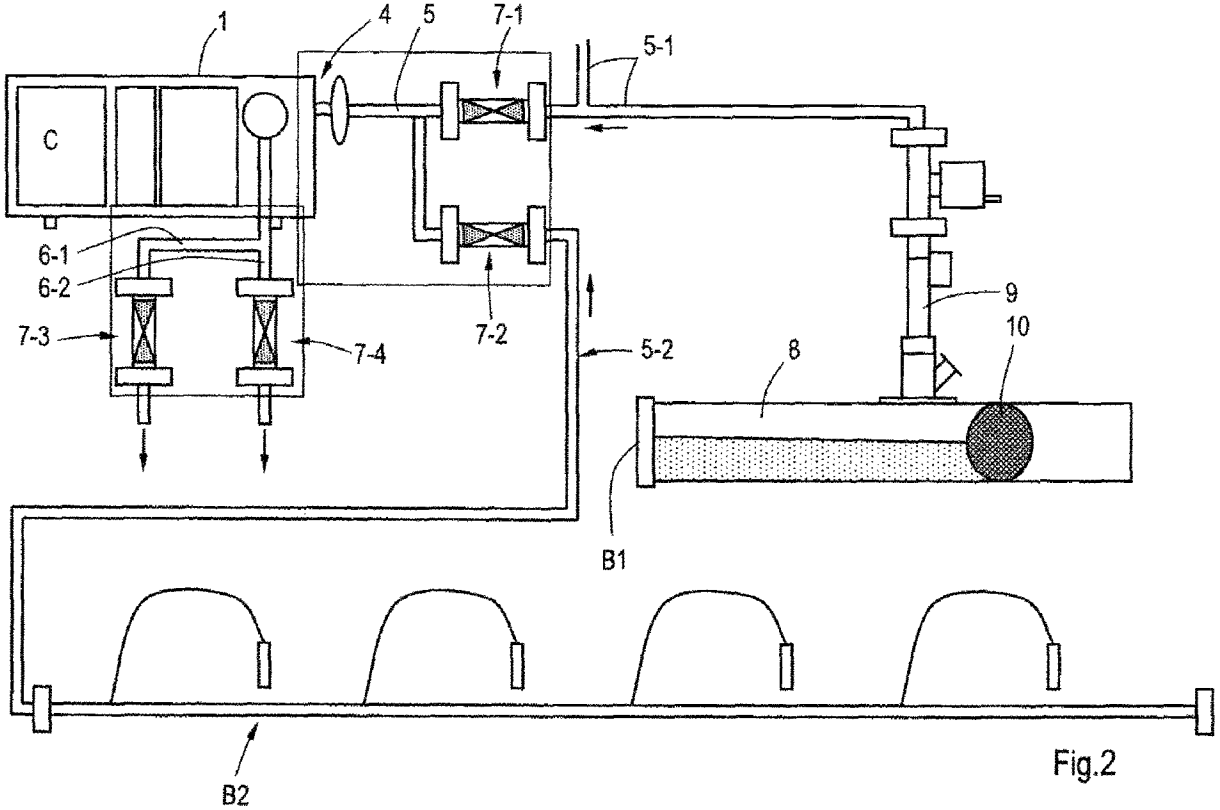
Figure 3:
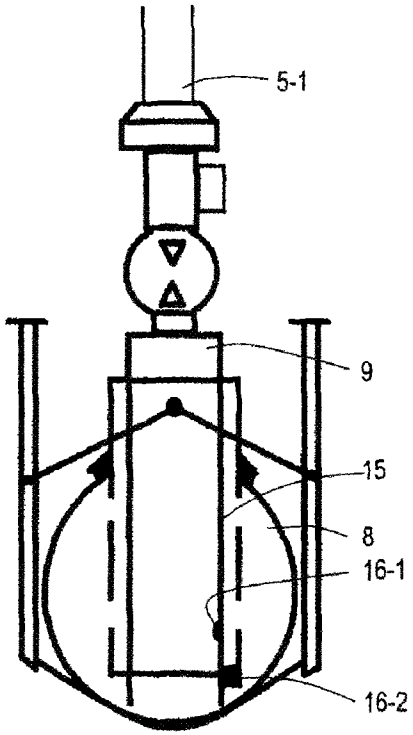

Next, the pump system and the method according to the present invention will be elucidated by means of the figures given below, in which corresponding parts are provided with the same reference numerals. In the figures:

FIG. 1 schematically shows a pump system which is known per se;

FIG. 2 shows a combination of possible embodiments of the pump system according to the invention; and FIG. 3 schematically shows a detail of the way in which a riser pipe, which is preferably provided with a capacitive level sensor, is connected to a sewage pipe which is bored on the upper side.

FIG. 1 schematically shows a part of a pump system 1 which is known per se, which is built up around a not self-starting medium pump 2 incorporated in the system 1, which medium pump will be of the grinder-type, if used in sewer applications. Such a pump 2 requires a sufficient amount of a medium, usually a fluid, hereinafter referred to as water, around its so-termed eye 3 in order to ensure that it starts well and operates satisfactorily. Examples thereof include a turbo pump, a vortex pump, a centrifugal pump or a vane-cell pump. After starting the pump, the water is drained off from the pump head 4 via drain pipes 6, said pump head including the part 5 of the supply pipe, which is directly connected thereto. Said part 5 is also indicated here as suction side and pipe 6 as delivery side of the pump system 1.

In case the part 5 of the supply pipe, and hence the eye 3, contains insufficient water, so that the pump 2 does not start by itself, the pump system 1 comprises a pipe portion 12 which is connected via a feature 11 to the part 5, to which pipe portion an air suction pump 13 is connected. Said suction pump 13 draws air from the pipe portion 12, thereby ensuring that the pipe 5 is filled with water to such a degree that the eye 3 sees enough water to at least enable the pump to start and operate whereby there is an under pressure in the pipe part 5. The feature 11, which acts as an air separator, is critically switched to the water/air position, making sure that only air, no water, (see upward-pointing arrow) can reach the suction pump 13, because this would give rise to the air-displacing effect of the air suction pump 13 being disturbed.

FIG. 2 shows the pump system 1, in which, inter alia, the medium pump 2 can be used in an overall pump system for waste water and clean water. The pump system 1 shown comprises separate medium supply pipes 5-1, 5-2 originating from different sources, which are jointly connected, via first, controllable valves 7-1, 7-2 to the pump head 4 of the pump system 1 via the pipe part 5. By virtue of this possibility, the system is very versatile, for example, because waste water can be processed by the same system 1 as clean water.

For example, it is possible to install, temporarily, a waste water system on the already present clean water system, or vice versa. By suitably, successively and individually controlling the controllable valves 7-1, 7-2, it is possible to switch to one or the other of the clean water/waste water systems. Said switching may be time-based or requirement-based and takes place in a controlled manner by means of liquid-level sensors. For controlling the opening and closing of the valves 7-1, 7-2, and/or the on/off switching of the pump 2, pump 13 and feature 11, use is made of a central, usually computer-controlled control unit C, to which also the controllable valves to be elucidated hereinafter and one or more level sensors are connected in a manner not shown here.

Supply pipe 5-1 is connected to a first source represented as waste water source B1, such as a sewage water source or a temporarily or not temporarily operating waste water source, sewage water source or pressure sewer water source. The source B1 at least comprises a drain pipe 8 and a substantially vertical riser pipe 9 provided in a sealing manner on an opening in the drain pipe, said opening being drilled at the top of the drain pipe 8, in which riser pipe or along the edge of which waste water can collect. On the left side in FIG. 2, the drain pipe 8 extends toward the source B1, that is to say, locations where sewage water is emitted, such as private houses, while on the right-hand side in the pipe 8 an internal shut-off 10 is located behind which there is a downstream part of the sewer, which may or may not be open, or on which work, such as repairs or extensions, can take place without trouble. In such cases, good drainage of sewage water or, in general, waste water from the emission points must be guaranteed. If the water rises to a specific critical level, up to the riser pipe 9 or even into the riser pipe, it must necessarily be pumped away.

The riser pipe 9 comprises, as shown in FIG. 3, an inside wall 14 and an outside wall 15, wherein, for example, one electrode 16-1 of the capacitive level sensor 16 may be provided on the inside wall 14 and the other electrode 16-2 may be provided on the outside wall 15 of the tube 9 in order to be able to detect when the critical level of waste water or sewage water in the sewer pipe 8 and/or riser pipe 9 is exceeded. Each one of the electrodes, which are preferably mounted in general at different heights, may alternatively be provided on the inner wall 14 or outer wall 15 or may be integrated therein. The pipe 9 then forms, or is provided with, a kind of dip stick reaching into the drain pipe or sewage drain pipe 8. Air has a different permittivity or relative dielectric constant $\in_r$ than water or waste water, and the presence or absence thereof is detected, in this case, capacitively in a manner which is known per se by means of the level sensor 16 connected to control unit C.

The operation of the system as described hereinabove is as follows. Based on the priority which is usually given to the drainage of sewage water, to prevent too much pollution of the environment as well as odour nuisance, the sensor 16, which detects sewage water in the drain pipe 8, will give instructions to close the valve 7-2, after which the valve 7-1 opens and the pump system 1, if not activated already, will be activated, causing the sewage water in pipe part 5 to be pumped away via the drain pipe 6 due to the under pressure. Said action as well as the next one are controlled by control unit C. If the sensor 16 subsequently sends a signal to the control unit C that the level in pipe 8 has decreased to below the minimum level, valve 7-1 will close, after which valve 7-2 is opened to pump clean water out of source B2, which in this case is a well-point dewatering system. Independent of whether medium originates from source B1 or B2, the controlled combination of pumps 2 and 13 jointly with feature 11 makes sure that air is removed from pipe 5, so that eye 3 is under water and pump 2 can operate independently.

In particular to drain pipe 6 of the system, a branch comprising pipes 6-1 and 6-2 can be added, in which respective controllable valves 7-3 and 7-4 connected to the control unit C can be incorporated. If separate drainage of waste water and clean water is desirable, this can be achieved by the timed opening and closing of the valves 7-1, 7-2, 7-3, 7-4 in the proper manner and sequence. As a result, the media originating from the separate sources B1 and B2, after being pumped by the single medium pump 2, are advantageously separately pumped via the separate drain pipes 6-1, 6-2. A certain hysteresis or time delay in the switching action of the said valves may be built in the programmable control unit C for the purpose of keeping clean water and waste water separate.

If necessary, the control unit C can have an Internet connection, so that not only the correct operation can be checked from a remote location but, if necessary, it is also possible to intervene in the pumping process from a remote location.

As a possible alternative to the above-mentioned capacitive sensor, use could be made of a resistance sensor and/or an inductive sensor.

The invention claimed is:

1. A pump system for liquid media, comprising:

at least one pump having a suction side and a delivery side, a control unit connected to the at least one pump, at least two controllable valves connected on one side thereof to the suction side, the valves being controlled by the control unit connected thereto, such that each valve only allows passage of medium from a first source or second source connectable to their respective other valve sides, and at least one level sensor connected to the control unit, the level sensor being positioned at least near that source where, in the case of a critical level being exceeded, medium must be pumped away, wherein the first source and the second source are pumped by a same pump of the at least one pump, and wherein the first source and the second source include at least two of waste water, sewage water, and clean water.

2. The pump system according to claim 1, wherein the first source is a waste water source, sewage water source or pressure sewer water source.

3. The pump system according to claim 1, wherein the second source is a clean water source.

4. The pump system according to claim 1, wherein the at least one level sensor is a capacitive, inductive level sensor and/or a resistance-measuring sensor.

5. The pump system according to claim 1, wherein the level sensor is positioned at least near a source of the first source and the second source that is operating as a waste water source.

6. The pump system according to claim 2, wherein the waste water source at least comprises a drain pipe and a substantially vertical pipe provided in a sealing manner on an opening in the drain pipe, in which vertical pipe waste water can collect, and which vertical pipe has an inside surface and an outside surface, wherein one electrode of the capacitive level sensor is arranged on the inside surface and the other electrode is arranged on the outside surface of said pipe to detect exceedance of the critical level.

7. The pump system according to claim 1, wherein the at least one pump is a self-starting pump.

8. The pump system according to claim 7, wherein the self-starting pump comprises a self-starting co-operating combination of a medium pump and an air pump.

9. The pump system according to claim 1, wherein the at least one pump comprises a medium pump, a turbo pump, a vortex pump, a centrifugal pump and/or a vane-cell pump.

10. The pump system according to claim 8, wherein the air pump is a vacuum pump.

11. The pump system according to claim 1, further comprising at least two controllable valves connected on one valve side to the delivery side, which are controlled in such a manner by the control unit connected thereto that each valve only allows passage of medium from the first source and/or the second source.

12. A method comprising:

pumping liquid media by a pump system from a suction side thereof to a delivery side thereof via first and or second valves which are controllable via a control unit and which are connected to, respectively, the suction and/or delivery side, wherein the control unit is arranged to make sure, in combination with at least one level sensor positioned near the first and/or second source and connected to the control unit, that at least each one of the first valves only allows passage of medium from a first or second source connected thereto, wherein the first source and the second source are pumped by a same pump of the pump system, and wherein the first source and the second source include at least two of waste water, sewage water, and clean water.

13. The method according to claim 12, wherein the level sensor is a capacitively operating level sensor to detect exceedance of a critical level of waste water when the first or second source is a waste water source.

14. The method according to claim 13, wherein the waste water source at least comprises a substantially vertical pipe where medium to be drained can collect, and which vertical pipe has an inside surface and an outside surface, wherein one electrode of the capacitive level sensor is arranged on the inside surface and the other electrode thereof is arranged on the outside surface of said vertical pipe.

15. The pump system according to claim 2, wherein the waste water source is a sewage water source or a temporarily or not temporarily operating waste water source.

16. The pump system according to claim 3, wherein the clean water source is a well-point dewatering source, soil dewatering source or drainage dewatering source.

* * * * *